US005335630A

United States Patent [19]

Nilsson

[11] Patent Number: 5,335,630

[45] Date of Patent: Aug. 9, 1994

[54] METHOD AND DEVICE FOR CONTROLLING THE POWER OUTPUT DURING COMBUSTION IN A FLUIDIZED BED

[75] Inventor: Karl-Johan Nilsson, Finspong, Sweden

[73] Assignee: ABB Stal AB, Sweden

[21] Appl. No.: 920,576

[22] PCT Filed: Feb. 20, 1991

[86] PCT No.: PCT/SE91/00126

§ 371 Date: Oct. 8, 1992

§ 102(e) Date: Oct. 8, 1992

[87] PCT Pub. No.: WO91/13289

PCT Pub. Date: Sep. 5, 1991

[30] Foreign Application Priority Data

Feb. 20, 1990 [SE] Sweden ..... 9000603-2

[51] Int. Cl.[5] ..... F22B 31/00

[52] U.S. Cl. ..... 122/4 D; 60/39.464; 165/104.16

[58] Field of Search ..... 122/4 D; 165/104.16; 60/39.464

[56] References Cited

U.S. PATENT DOCUMENTS 4,748,940 6/1988 Hönig ..... 122/4 D
4,909,163 3/1990 Hjalmarsson ..... 60/39.464 X
5,163,384 11/1992 Brännström et al. ..... 122/4 D

FOREIGN PATENT DOCUMENTS 0068301 6/1992 European Pat. Off. .

*Primary Examiner*—Edward G. Favors

[57] ABSTRACT

In a method and device for controlling power output during combustion in a pressurized fluidized bed, energy developed is taken out by heat transfer surfaces and a gas turbine, and heat is utilized in a steam turbine. The heat transfer surfaces include a high pressure section with one evaporator and a low pressure section with at least one intermediate superheater. In case of changes in the power output, the bed depth of the fluidized bed is varied, whereby heat transfer surfaces included in the evaporator are exposed or covered by the bed and production of high pressure steam, evaporation power, is controlled. Heat taken from the fluidized bed is controlled by controlling the temperature difference between the bed and low pressure stream flowing in the intermediate superheaters. High pressure steam, produced in the evaporator is superheated in a heat exchanger arranged outside the bed by low pressure steam from the intermediate superheaters before it is expanded in a high pressure steam turbine.

4 Claims, 1 Drawing Sheet

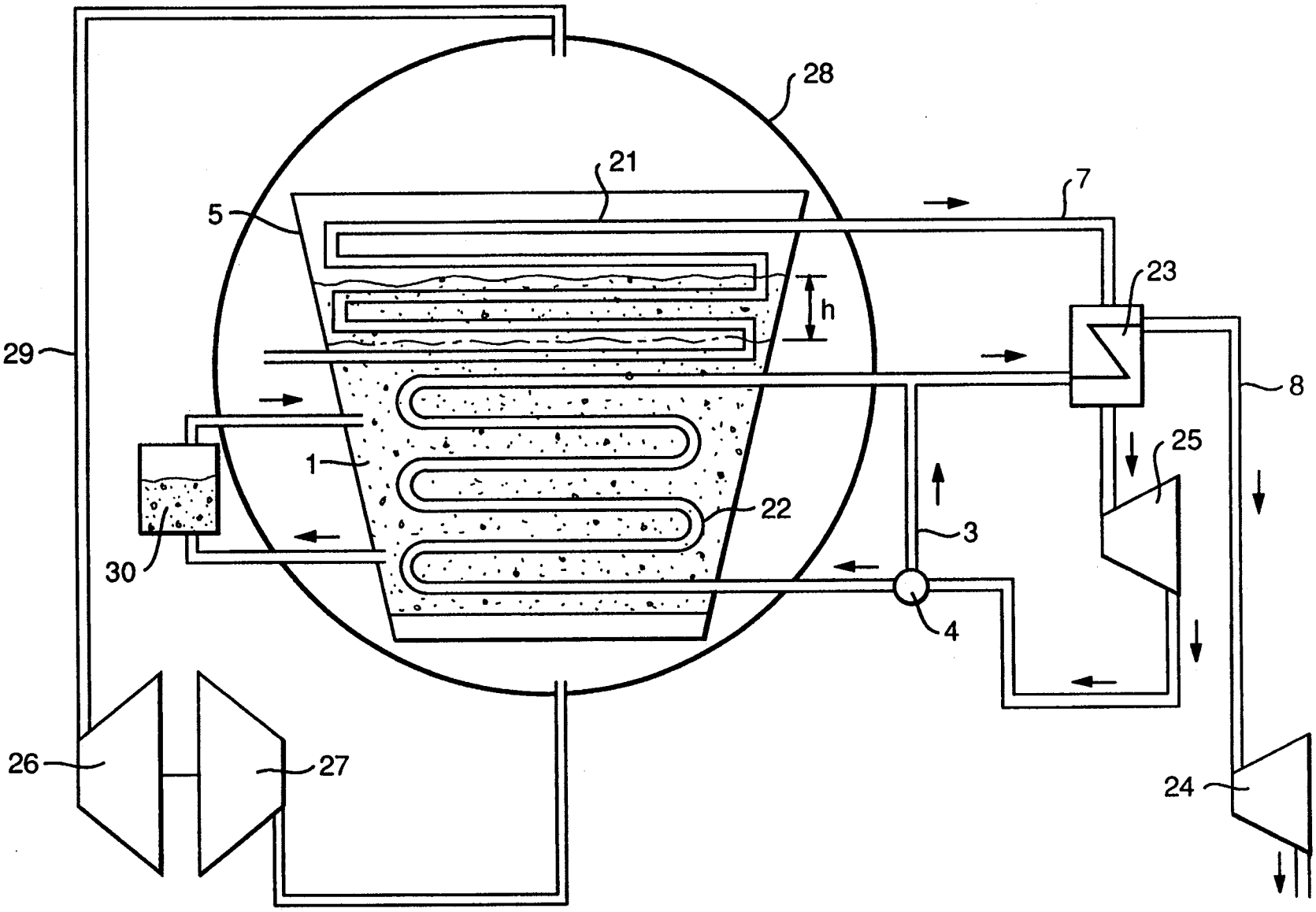
8
23
25
24
7
3
4
28
h
22
21
1
5
27
30
29
26

METHOD AND DEVICE FOR CONTROLLING THE POWER OUTPUT DURING COMBUSTION IN A FLUIDIZED BED

FIELD OF THE INVENTION

The present invention relates to the control of the power output during combustion of fuel in a fluidized bed in which energy is recovered with heat transfer surfaces, arranged close to the fluidized bed, which are traversed by a liquid or gaseous heat transfer medium.

The invention is particularly valuable in power plants with combustion in a pressurized fluidized bed, PFBC (Pressurized Fluidized Bed Combustion) plants, where energy is recovered with a gas turbine and a steam turbine in combination. In such a plant the invention makes possible a more rapid change of the power output, an increase of the gas temperature at partial load, and control of the power balance between gas turbine and steam turbine during operation.

BACKGROUND OF THE INVENTION

During combustion of fuels in a fluidized bed, the power output is usually controlled by changing the bed depth. With conventional fluidized bed boilers for the production and superheating of steam, which is expanded in a steam turbine, the control of the bed depth in case of changes of the power output entails the transportation of large quantities of bed material back and forth to the fluidized bed. These large material flows require a complicated transport systems involving, among others, intermediate storage containers for bed material. In addition, the considerable bed depth adjustments and the associated material flows as well as the exposure of large heat transfer surfaces result in a slow control and in the temperature of the flue gases falling in case of partial load, which is reflected in inferior environmental performance.

If the fluidized bed is pressurized, that is, is included in a plant for combustion in a pressurized fluidized bed, a PFBC (Pressurized Fluidized Bed Combustion) plant, in which energy is recovered also from the hot pressurized flue gases by means of gas turbines, conventional control of the power output with bed depth adjustments also results in the efficiency of the plant decreasing with decreasing flue gas temperature as well as in considerable difficulties in adjusting the power balance between the steam and gas turbines during operation.

SUMMARY OF THE INVENTION

The heat transfer surfaces included in the fluidized bed boiler are arranged in a high pressure section, comprising an evaporator and a possible superheater, as well as a low pressure section, with one or more intermediate superheaters. In the fluidized bed, the heat transfer surfaces are arranged, according to the invention, such that, in case of a change of the bed depth, substantially heat transfer surfaces included in the evaporator are exposed from or covered by the fluidized bed whereas heat transfer surfaces included in the intermediate superheater are substantially located in the fluidized bed irrespective of the power output. A fluidized bed boiler designed and arranged according to the invention and with evaporation and superheating of steam carried out according to the invention requires a considerably smaller change of the bed depth in case of a corresponding change of the power output than a conventionally arranged fluidized bed boiler. In addition, with a fluidized bed boiler according to the invention, a direct control of the evaporation power is obtained by changes of the bed depth.

By concentrating the evaporator substantially to the upper part of the fluidized bed in this way, a direct and rapid control of the evaporation power upon a change of the bed depth is obtained. In addition, at a given change of the power output, a considerably smaller change of the bed depth is needed in a plant with the evaporator arranged according to the invention, than in a plant with a conventionally arranged evaporator. In addition, the flue gas temperature is not changed to the same extent as a result of changes in the power output.

A fluidized bed boiler arranged such that the flow of a heat transfer medium through the boiler is varied to control the mean temperature difference between the fluidized bed and the heat transfer medium, and hence also the heat taken from the bed, requires a considerably smaller bed depth change for a certain change in the energy output than a conventional boiler. This gives a rapid control and a small change of the flue gas temperature, which in turn improves the environmental performance, for example the possibilities of nitrogen oxide reduction. Further, if the fluidized bed is part of a power plant with combustion in a pressurized fluidized bed where energy is also recovered from the pressurized flue gases with gas turbines, the possibilities of adjusting, in operation, the power balance between the steam and gas sides are also improved.

The flow through the boiler is suitably varied as a heat transfer medium to a varying degree is bypassing the boiler. In this way, the temperature of the heat transfer medium is changed and hence also the temperature difference between the fluidized bed and the medium and consequently the heat taken out by the heat transfer medium from the fluidized bed.

With a fluidized bed boiler comprising an evaporator, a superheater and an intermediate superheater, and according to the invention supplemented by at least one external heat exchanger in which high pressure steam from the evaporator is superheated by hot steam of a lower pressure from the intermediate superheater, low pressure steam, and in which according to the invention the temperature difference between the fluidized bed and a medium flowing in the intermediate superheater, low pressure steam, is controlled through bypasses and recirculation in the circuit for low pressure steam, a rapid control of the power output is obtained.

The evaporator is supplied with feedwater which is evaporated to high pressure steam. Before the high pressure steam is expanded in a high pressure steam turbine, its energy contents are further increased by superheating it, according to the invention, in at least one heat exchanger located outside the fluidized bed. The heat for the superheating of high pressure steam is taken from steam of lower pressure which has been supherheated in at least one intermediate superheater arranged in the fluidized bed.

The intermediate superheater is supplied with steam of low pressure, preferably a sub-quantity of the steam expanded in the high pressure steam turbine, which is greatly superheated. Through a bypass duct arranged outside the fluidized bed, an additional sub-quantity of the steam expanded in the high pressure steam turbine is bypassed the intermediate superheater. The superheated low pressure steam and the low pressure steam, which by means of the bypass duct is conducted past the superheater, are mixed downstream of the intermediate superheater and supplied to at least one heat exchanger arranged outside the fluidized bed, the cooling medium of which is high pressure steam, before the energy is recovered from the low pressure steam through expansion in a low pressure steam turbine. By superheating low pressure steam, by the possibility to bypass the intermediate superheater and by designing the intermediate superheaters of high temperature resistant material, the low pressure steam may be superheated to a temperature very close to the temperature of the fluidized bed. In this way, the possibility of changing the mean temperature difference between fluidized bed and low pressure steam, and hence the possibility of controlling power transferred to the intermediate superheater in relation to a conventionally designed fluidized bed boiler, are increased.

The temperature of the low pressure steam is controlled by varying the percentage of steam conducted past intermediate superheaters.

The flue gas temperature is not changed to the same extent with changed power output in a fluidized bed, with the heat transfer surfaces arranged according to the invention, with superheating of high pressure steam according to the invention, and with control of the mean temperature difference between fluidized bed and low pressure steam according to the invention, as in a fluidized bed with a conventionally arranged fluidized bed boiler, which means, if the fluidized bed is part of a power plant with combustion in a pressurized fluidized bed and where energy is recovered with a gas turbine from the hot, pressurized flue gas, that the efficiency is increased, and that the possibilities of achieving improved environmental performance are increased.

The invention also greatly improves the possibilities to control of the power balance between the steam and gas turbines.

BRIEF DESCRIPTION OF THE DRAWINGS

The invention will be described in greater detail with reference to FIG. 1 .

FIG. 1 shows a fluidized bed boiler arranged in a power plant for combustion in a pressurized fluidized bed, a PFBC—Pressurized Fluidized Bed Combustion—plant, which according to the present invention has been arranged in a high pressure section with an evaporator which is connected to a high pressure steam turbine and a low pressure section with one or more intermediate superheaters which is or are connected to external heat exchangers for superheating of the high pressure steam, with possibilities of bypassing of the intermediate superheater before the low pressure steam is finally expanded in a low pressure steam turbine.

DESCRIPTION OF THE PREFERRED EMBODIMENTS

The invention as applied to combustion in a fluidized bed 1, included in a plant with combustion in a pressurized fluidized bed, a PFBC plant, is illustrated in FIG. 1. Heat transfer surfaces 21, 22 for recovery of energy developed during the combustion are arranged in the fluidized bed 1, in the walls of the bed vessel 5 surrounding the fluidized bed 1, in the freeboard 6 above the fluidized bed 1 or in flue gas ducts 29 provided downstream of the fluidized bed 1.

According to the invention, the heat transfer surfaces are arranged in a high pressure circuit 7 in the form of an evaporator 21 for the production of high pressure steam and possibly a superheater (not shown) and a low pressure circuit 8 in the form of one or more intermediate superheaters 22. The intermediate superheater 22 included in the low pressure circuit 8 is arranged in the fluidized bed 1 for superheating of low pressure steam. Heat taken out by means of the evaporator 21 and the intermediate superheater 22 is utilized in at least one steam turbine 24, 25 connected to the heat transfer surfaces 21, 22 whereas energy from the hot pressurized flue gases is recovered with at least one gas turbine 26 arranged in the flue gas duct 29. The gas turbine 26 drives a compressor 27 for pressurization of the gas, preferably air, which is supplied to a pressure vessel 28 arranged around the bed vessel 5.

According to the invention, the flow of and the inlet temperature of the low pressure steam which is superheated in the intermediate superheater 22 are varied, heat taken out from the fluidized bed thus being controlled. The flow is varied by conducting the low pressure steam to a varying degree past the intermediate superheater 22, for example through a bypass duct 3 arranged outside the fluidized bed 1. The distribution of the flow between the intermediate superheater 2 and the bypass duct 3 is controlled by a valve 4. By superheating only steam of low pressure in the intermediate superheater 22 and designing the intermediate superheater 22 of high temperature resistant material, the low pressure steam may be superheated to temperatures close to the temperature of the fluidized bed 1. This increases the possibilities of controlling the output heat with the intermediate superheater 22, which in the low pressure section 8 is connected to at least one heat exchanger 23 arranged outside the fluidized bed 1, by bypassing the intermediate superheater 22 and the heat exchanger 23, respectively, to a varying degree. The low pressure steam superheated in the intermediate superheater 22 is used to superheat, in the heat exchanger 23, high pressure steam produced in the evaporator 21 before the low pressure steam is finally expanded in a low pressure steam turbine 24.

The high pressure steam superheated in the heat exchanger 23 is expanded in a high pressure steam turbine 25 and a sub-quantity of the low pressure steam thus obtained is suitably supplied to the low pressure circuit 8. By arranging the heat transfer surfaces in the fluidized bed 1, according to the invention, such that, in case of changes of the bed depth, the evaporator 21 is substantially exposed or covered by the fluidized bed 1, changes in the bed depth h are immediately reflected by changes in the evaporation power. In this way, considerably smaller changes of the bed depth are needed with the heat transfer surfaces 21, 22 arranged according to the invention, in relation to a conventional fluidized bed boiler, to achieve a certain change in the power output.

With the greatly improved possibilities of control of the evaporation power and of the output heat from the fluidized bed 1, according to the invention, valuable improvements in the control and operation of a PFBC plant are obtained, namely:

A more rapid change of the power output since the need of bed depth changes and the associated transport of bed material back and forth to the fluidized bed, for example, through schematically shown means 30 are considerably reduced with the heat transfer surfaces 21, 22 arranged and connected according to the present invention.

The dependence of the flue gas temperature on the power output is considerably reduced by the reduction of the bed depth changes, and in this way the efficiency and environmental performance of the plant can be kept less dependent on the power output.

The power balance between the gas and steam sides may be adjusted during operation.

I claim:

1. A method of controlling the power output during combustion of fuel in a pressurized fluidized bed, comprising the steps of:

1) providing heat transfer surfaces arranged in or down stream of the fluidized bed the heat transfer surfaces including a high pressure section with at least one heat transfer surface in the form of an evaporator and a low pressure section with a heat transfer surface in the form of at least one intermediate superheater;

2) causing traversing of the heat transfer surfaces by liquid or gaseous medium to at least partially take out, as output heat the energy developed during the combustion;

3) utilizing the output heat in at least one steam turbine connected to the heat transfer surfaces;

4) recovering energy contained in the hot pressurized flue gases in at least one gas turbine arranged in a flue gas path downstream of the fluidized bed;

5) maintaining the power balance between the gas turbine and the steam turbine by controlling the power taken out in the heat transfer surfaces in case of change of the bed depth as a result of a change in the power output, said controlling including the steps of:

a) controlling the production of high pressure steam, the evaporation power, by exposing from and covering by the fluidized bed, respectively, the heat surfaces included in the evaporator though changes in the bed depth;

b) at the same time controlling heat taken from the fluidized bed by means of the intermediate superheater by controlling the mean temperature difference between the fluidized bed and a medium flowing in the intermediate superheater in the form of low pressure steam, and superheating the low pressure steam, and c) also, at the same time, controlling the temperature/energy contents of the high pressure steam by superheating high pressure steam, produced in the evaporator before it is expanded in a high pressure steam turbine, by means of low pressure steam from the intermediate superheater in at least one heat exchanger arranged outside the fluidized bed.

2. A method according to claim 1, further including the steps of:

controlling heat taken out from the fluidized bed by dividing the steam expanded in the high pressure steam turbine into first and second sub-quantity of low pressure steam;

supplying the first sub-quantity to the intermediate superheater and conducting the second sub-quantity past the intermediate superheater;

controlling the mean temperature difference between the fluidized bed and the low pressure steam and heating the low pressure steam to a high temperature without the pressure being essentially changed; and mixing the first and second sub-quantities of low pressure steam downstream of the intermediate superheater and supplying to at least one heat exchanger, arranged outside the fluidized bed, for controlling the temperature of high pressure steam supplied to the high pressure steam turbine before the low pressure steam is expanded in a low pressure steam turbine.

3. A device for controlling the power output during combustion of fuel in a pressurized fluidized bed comprising:

a) heat transfer surfaces for taking out as heat output at least a portion of energy developed during the combustion, said heat transfer surfaces being arranged in or downstream of the fluidized bed, and being adapted to be traversed by a liquid or gaseous medium, b) at least one steam turbine adopted to utilize the heat taken out, said steam turbine being connected to the heat transfer surfaces;

c) the heat transfer surfaces including a high pressure section with at least one heat transfer surface in the form of an evaporator and a low pressure section with a heat transfer surface in the form of at least one intermediate superheater;

d) at least one gas turbine arranged downstream of the fluidized bed, in a flue gas duct, for recovery of energy contained in the hot pressurized flue gases;

e) means for controlling the production of high pressure steam, the evaporation power, by exposing from and covering by the fluidized bed, respectively, the heat surfaces included in the evaporator;

f) means for simultaneously controlling the heat taken form the fluidized bed by controlling the mean temperature difference between the fluidized bed and a medium flowing in the low pressure section in the forth of low pressure steam, said means including at least one bypass duct and at least one valve for controlling said mean temperature difference; and g) means for also simultaneously controlling the temperature/energy contents of the high pressure steam by superheating high pressure steam, produced in the evaporator before it is expanded in a high pressure steam turbine, by low pressure steam from the intermediate superheater, said means including at least one heat exchanger arranged outside the fluidized bed.

4. A device for controlling the power output during combustion of fuel in a pressurized fluidized bed;

heat transfer surfaces arranged into a high pressure circuit including an evaporator for production of high pressure steam and a low pressure circuit including at least one intermediate superheater arranged in the fluidized bed for superheating of low pressure steam;

at least one low and high pressure steam turbine for utilizing heat taken out by the evaporator and the intermediate superheater;

at least one gas turbine in the flue gas duct for recovering energy from the hot pressurized flue gases;

means for controlling the production of high pressure steam, the evaporation power, in case of changes of bed depth, by substantially exposing or covering the evaporator by fluidized bed whereby the changes of the bed depth are reflected by changes in the evaporation power;

means for controlling flow and inlet temperature of low pressure steam being superheated in the intermediate superheater;

at least one heat exchanger arranged outside the fluid bed for receiving the superheated low pressure steam, and for superheating with the low pressure steam, the high pressure steam from the evaporator before expending the low pressure steam in a low pressure steam turbine; and at least one bypass duct and at least one valve for controlling the mean temperature difference between the fluidized bed and a medium flowing in the low pressure circuit, the low pressure steam.

* * * * *